United States Patent [19]

Lesley et al.

[11] 4,391,934

[45] Jul. 5, 1983

[54] DRY TEXTILE WARP SIZE COMPOSITION

[75] Inventors: David J. Lesley, Greer; Lawrence C. Davis, Jr., Spartanburg, both of S.C.

[73] Assignee: ABCO Industries, Inc., Roebuck, S.C.

[21] Appl. No.: 213,328

[22] Filed: Dec. 5, 1980

[51] Int. Cl.[3] ..... C08L 1/28; C08L 3/00

[52] U.S. Cl. ..... 524/43; 524/47; 428/264; 428/265; 428/290

[58] Field of Search ..... 260/9, 16, 17.4 R, 17.4 CL, 260/17.4 ST, 29.2 E, 29.2 N, 31.8 XA, 33.4 R; 117/138.8; 427/209, 211, 428, 439; 428/264, 265, 290, 392, 480, 481; 523/200, 205, 207; 524/1, 43, 47, 284, 300; 57/140 C

[56] References Cited

U.S. PATENT DOCUMENTS

| | | | |
|---|---|---|---|
| 2,824,023 | 2/1958 | Banigan | 260/17.4 ST |
| 3,027,338 | 3/1962 | Chetakian | 260/17.4 X |
| 3,931,422 | 1/1976 | Bateman et al. | 260/9 |
| 3,981,833 | 9/1976 | Lark | 260/9 |
| 4,006,112 | 2/1977 | Bateman et al. | 260/9 |

*Primary Examiner*—John Kight, III
*Assistant Examiner*—Nathan M. Nutter
*Attorney, Agent, or Firm*—Wellington M. Manning, Jr.; Luke J. Wilburn, Jr.

[57] ABSTRACT

A dry textile warp size composition for use in the sizing of yarns containing natural fibrous materials, synthetic fibrous materials, or blends of same including a polyester in particulate form, a film former, and optionally a lubricant and other minor additives. The polyester is preferably rendered into particulate form by grinding at reduced temperature, includes anionic hydrophilic groups and is at least substantially saturated. A process for producing the size composition is also disclosed and claimed.

23 Claims, No Drawings

DRY TEXTILE WARP SIZE COMPOSITION

BACKGROUND OF THE INVENTION

The present invention relates to a particular warp size composition for the application to certain yarns of blends of synthetic and natural fibers or wholly of natural or synthetic fibers to improve the overall performance, economics, and handling of same during fabric formation.

It is necessary to apply a warp size composition to textile strands or yarns to permit handling of the materials during fabric formation operations, normally weaving, to preclude damage to the yarns during such operations. In general, from commercial and operational standpoints, size compositions that are applied to the yarns must meet certain criteria for successful use in performance of the intended purposes. For example, irrespective of the yarn materials utilized in fabric formation, the size must adhere thereto throughout the operation to protect the fibers from abrasion due to contact with process equipment or adjacent fibers, and thereafter must be easily removable from the formed fabric to permit further finishing and processing of the fabric.

During the evolution of synthetic polymeric filamentary materials, and spun yarns produced therefrom, it became evident that the general types of sizing compositions historically utilized for application to natural fibrous materials were not satisfactory. Particularly, the synthetic polymeric materials are hydrophobic in nature whereas the natural fibrous materials are hydrophilic in nature. Hence different materials were needed that would properly adhere to the synthetic polymeric yarns.

Natural, or generally hydrophilic fibers such as cotton, linen, rayon and the like may be sized with various forms of starch, such as hydrolyzed starches, dextrins, partially esterified starches,and partially etherified starches. Additionally, water soluble carboxymethyl cellulose, water-soluble hydroxyethyl cellulose, natural gums such as guar, gum arabic, sodium alginate and the like may also be used. The above noted sizing agents for natural fibers are generally film formers, and are not in general suitable for use, per se, on synthetic, polymeric fibers such as nylon, polyester, polyacrylonitrile, and cellulose acetate, and likewise on glass fibers. Particularly, aqueous dispersions or solutions of only the above referred to size agents will not adhere to the synthetic, or glass fibers or filaments to afford the protection necessary during fabric formation.

It has been previously determined that certain polymeric sizing agents which are either water dispersible, water soluble, or soluble in dilute alkaline solutions may be suitably employed to size the hydrophobic, synthetic polymeric fibers and filaments. Exemplary of such polymeric sizing agents, without limitation, include polyacrylic acid, polymers of acrylonitrile, polymers of lower alkyl acrylates, maleic anhydride copolymers, polyvinyl alcohol, polyesters and the like.

Depending upon the chemical structure of the polymeric sizing agent, the agent may be suitable for application to both synthetic filamentary materials and spun yarns that contain synthetic fibrous materials. Certain functional groups, if present, on the polymeric size, may render same unsuitable for spun yarns. For example, if during the processing of same, the size is cross linked or otherwise reacted with the synthetic fibrous material in the blend, easy removability of the size is hindered, if not totally negated.

Today's textile market finds the natural fibers appreciably more expensive than the manmade fibers, whereby blends of the two have been utilized successfully for many fabric end uses. Moreover, the manmade or synethetic fibers possess certain qualities that render yarns or blends containing same desirable due to improved physical properties. A single strand of spun yarn constituted by a blend as mentioned hereinbefore has both hydrophilic and hydrophobic characteristics, and accordingly, in order to apply a size composition thereto that is adequately adherent to both types of fiber constituents, it has generally been accepted that blends of size constituents such as those set forth above should be utilized.

Polyester resins suitable for use in warp size compositions for spun yarns that include synthetic fibers in general, due to the chemical composition of same, are generally adhesive at ambient conditions such that agglomeration of particles of resin occurs, even due to cold flow. Consequently polyester-starch or other textile size compositions utilizing a polyester resin have heretofore been blended at the time of preparation of the aqueous dispersion just prior to use, or prepared and shipped as an aqueous dispersion.

Generally the formation of an aqueous dispersion of a blend of size ingredients whether for spun blends or otherwise is accomplished by mixing the ingredients according to a particular recipe in a cooking vessel along with the dispersing medium, generally water, and bringing the mixture to a desired consistency for application to the yarn. Since formulation is generally conducted just before application, and thus may occur at any hour of the day, potential problems exist with maintenance of uniformity of ultimate size compositions, particularly since unskilled laborers are often involved.

To some extent, attempts have been made to circumvent the above noted problems. A particular example of such an attempt is a size composition referred to in the Lark U.S. Pat. No. 3,981,833 which is directed to a warp size composition that includes starch or some other size ingredient suitable for adhesion to the hydrophilic yarns and a polyester resin suitable for adherence to polyester yarns. The Lark composition is generally directed to a pasted starch blended with a polyester resin. Pasted starch of course refers to an aqueous starch composition which is later blended with the polyester resin at the consumer's location, or alternatively, the two may be preblended, and the aqueous blend shipped to the consumer. Lark thus appears to perhaps reduce problems attendant with formulating the size composition at the time of use, but does not overcome same.

Under all known prior art conditions, the consumer either relied upon unskilled labor in preparation of the size composition, or was required to purchase the preblended aqueous dispersion which included the cost of preblending and shipping the water. The present invention provides a dry, premixed, size composition which alleviates the aforementioned agglomeration or cold flow problems of the polyester constituent; affords ease of bulk handling and package compatibility of ingredients; is economical to transport; is provided to the consumer in a form that eliminates mixing errors, and further attributes improvement in weaving performance of the spun yarns sized therewith. According to the present invention, the polyester resin is provided in particulate form in such a manner that agglomeration is precluded, whereby a proper complete blend of size ingredients may be supplied to the consumer which can then be easily and conveniently dispersed in an aqueous medium as desired.

Polyester resins in general have heretofore been provided in particulate form for certain purposes, e.g., for the formation of casting or molding resins. The Chetakian et al U.S. Pat. No. 3,027,338 is directed to a polyester molding composition that is fiber reinforced. The polyester constituent of the molding composition, in crystalline form, is ground at a low temperature, below the melting point of the resin after which the molding composition is produced. In similar fashion, Cruz et al U.S. Pat. No. 3,931,082, relates to colloidally dispersible microcrystalline polyesters which are hydrolyticly treated to remove amorphous regions after which the polyester is mechanically disintegrated by various techniques, one of which is freeze grinding. Neither Chetakian nor Cruz, Jr., et al, however, in any way relate to a warp size composition for textile materials, and in fact, the polyesters of same are unsaturated and would thus not be suitable for use as textile size ingredients.

U.S. Pat. Nos. 3,546,008 to Shields et al and 4,150,946 to Neel both disclose polyesters suitable for use as textile size compositions and that the resin may be provided in pellet, powder or flake form at the time of preparation of the aqueous dispersion of same. The Shields et al and Neel polyesters, however, are intended for use as polymeric sizes for synthetic filaments and are not suitable in their present form for use as size ingredients according to the present invention since during processing of the yarns with a conventional alkali scour, the polyester size of Shields or Neel would become affixed to the synthetic fibers and could not be easily removed.

The present invention thus affords numerous advantages over prior art warp size compositions for fibrous yarns of synthetic and/or natural fibrous materials as set forth above, and known prior art is not believed to anticipate or suggest same.

SUMMARY OF THE INVENTION

It is an object of the present invention to provide an improved warp size composition for use in the sizing of yarns that contain synthetic fibers, natural fibers, or blends of same.

Another object of the present invention is to provide an improved warp size composition for use in sizing yarns of natural-synthetic fiber blends.

Still further another object of the present invention is to provide a dry warp size composition containing a film former and a particulate polyester resin.

Yet another object of the present invention is to provide an improved complete warp size composition that needs only to be appropriately processed with an aqueous medium prior to use in the sizing operation.

Still another object of the present invention is to provide an improved process for producing a textile warp size composition suitable for sizing of yarns that contain synthetic fibers, natural fibers or blends of same.

Generally speaking, the dry textile warp size composition of the present invention comprises a blend of a polyester resin, said resin including ionic hydrophilic groups therein, said resin further being at least substantially saturated and in particulate form, and a film former, said blend being at least water dispersible, and the particulate polyester resin in said blend being at least substantially non-adherent to adjacent resin particles.

More specifically, the dry textile warp size composition of the present invention contains a film former, such as starch, carboxymethyl cellulose, polyvinyl alcohol or the like, or a mixture of same for use in sizing a hydrophilic component of the textile material, such as a cellulosic ingredient, and a polyester resin that has been provided in particulate form, for example by grinding at a temperature where during the grinding operation, agglomeration of the particulate resin will not occur. Subsequent to, or simultaneous with rendering of the polyester resin into particulate form, the resin is blended with the film former under conditions where the resin is coated with the film former prior to any chance for agglomeration, whereby the polyester resin thereafter remains in particulate form, even under humid conditions. Depending upon the particular polyester resin being utilized, it may be necessary to add a carboxyl neutralizing agent to the composition to render same at least water dispersible. For preferred resins according to the present invention, the amount of alkali added would place pH of the composition in a range of from $5\frac{1}{2}$ to about 7.

More specifically, the dry textile warp size composition of the present invention contains a particulate polyester resin that possesses adequate adhesive qualities for bonding to the fibrous material to reduce shedding, while being easily removable in a conventional scour, and a film former as exemplified by starch, carboxy methyl cellulose, polyvinyl alcohol or the like. Optionally the blend may also include a lubricant, such as a wax, and other general ingredients such as stabilizers, defoamers, antistats and the like to provide a total size package that only needs dispersing in the aqueous medium.

While preferred polyester ingredients are specifically discussed hereinafter, any polyester could be employed so long as the requisite qualities for a sizing resin are present. Such in general requires substantial saturation to avoid cross linking or other reaction with the synthetic fibrous material, and adequate hydrophilicity to ensure easy removability from the yarn during scouring. As also set forth hereinafter, while for the preferred polyester resins, cryogenic grinding is necessary or preferred to provide the resin in particulate form, suitable polyesters may also be processed otherwise such as by pelletizing, prilling, flaking or the like. For purposes of the present application, only grinding of the polyester is discussed in detail as a means for rendering the resin in particulate form.

The preferred polyester resin for use in size compositions according to the present invention is produced by reacting a glycol such as diethylene glycol with a dicarboxylic acid or the like as exemplified by isophthalic acid and trimetallitic anhydride in the presence of an appropriate catalyst. For suitability as a size resin, the preferred polyesters should have an acid value of at least 20, and preferably at least 30.

The process of the present invention generally includes the steps of providing a polyester resin that is at least substantially saturated and has ionic hydrophilic groups thereon, rendering said resin into particulate form, said particles being of a size to permit dispersion of said resin in an aqueous medium, and mixing a predetermined amount of a film former with said particulate resin to achieve a blend of ingredients in which said resin particles will not adhere to adjacent resin particles under normal shipping and storage conditions.

In the case of the preferred type of polyester, the process of the present invention includes the steps of providing a polyester resin having an acid value of at least about 20, grinding the polyester resin to a particulate size no greater than about 5 mesh U.S. Standard Sieve size under conditions where there is no appreciable agglomeration of the ground resin and mixing a predetermined amount of a film former with the ground resin adequate to coat the surfaces of said ground resin sufficient to preclude agglomeration of the resin at ambient temperature.

Preferably the preferred polyester resin is cryogenically ground, at resin temperatures of 0° F. or lower, with the temperature of the grinding means being lowered, if necessary. Thereafter, and before temperature of the particulate resin reaches a point where agglomeration occurs, the film former is mixed therewith. Alternatively, the film former may be mixed with the resin in the grinder where blending occurs in situ as the resin is being ground. In any event, the film former should coat the particulate resin adequately to preclude subsequent agglomeration or fusion of the resin particles at higher temperature conditions.

DESCRIPTION OF PREFERRED EMBODIMENTS

Dry warp size compositions according to teachings of the present invention are intended for use in the warp sizing of yarns that contain natural or synthetic fibrous material. Yarns spun from fiber blends which include both hydrophilic and hydrophobic fibrous constituents are included as well as spun yarns that contain only natural or synthetic fibers. In like fashion the present size compositions would be suitable for synthetic filamentary materials that have been altered to assume the appearance and characteristics of spun yarns, and such is included in the context of the term yarn as used herein. Hydrophilic constituents of blends are basically naturally occurring fibrous materials or chemically modified naturally occurring fibrous materials such as cotton, linen, rayon, wool and the like. Hydrophobic constituents of the fiber blends are basically synthetic fibrous materials to which a polyester resin will adhere adequately for the intended purpose while being easily removable therefrom. Exemplary of such hydrophobic fibrous materials are nylon, polyesters, polyacrylonitrile, cellulose esters such as cellulose acetate, fiber glass and the like. In a preferred situation, however, the size composition according to teachings of the present invention is directed to spun yarns constituted from polyester-cellulosic fiber blends.

The polyester fibrous materials referred to herein, in general, include, without limitation, fibers prepared from synthetic polymers that are provided by the reaction products of a dicarboxylic acid, or an ester forming derivative of same, e.g., dimethyl terephthalate, condensed with a glycol, e.g., ethylene glycol to provide a polymer of the glycol ester of the dicarboxylic acid. Normally, such polyesters are polyethylene terephthalate and modified polyethylene terephthalates.

Dry warp size compositions according to the present invention include, as essential ingredients, particulate polyester resin having a particle size that permits the resin to form an aqueous dispersion for application onto the textile materials and a film former.

Suitable polyester resins should contain ionic hydrophilic groupings thereon, either anionic in nature as exemplified by alkali salts of carboxylates, sulfates, sulfonates, and phosphates, or cationic in nature as exemplified by quaternary sulfates, quaternary ammonium chloride and the like. Further, the term "ionic hydrophilic" is intended to include those groupings that are initially of hydrophilic character and those groupings that assume hydrophilicity after some treatment, such as after neutralization of carboxyl groups. In like fashion, the polymer should be adequately saturated that reaction or other bonding will not occur between the polymer and the fibrous materials under alkaline or thermal conditions, which would retard removability of the size polymer.

A preferred polyester resin for use in the warp size compositions according to the present invention, as set forth hereinabove, is produced by reacting diethylene glycol with isophthalic acid and trimellitic anhydride in the presence of an appropriate catalyst. The particular combination of ingredients is charged to a polymerization reaction vessel and heated to a temperature in the range of from about 400° to about 450° F., after which the temperature is held for a period of time until an acid value as desired for the polymer is achieved. In a most preferred situation, the reactants include 50.877 moles of diethylene glycol; 40.610 moles of isophthalic acid; 5.500 moles of trimellitic anhydride; and 0.01 percent of a titanium isopropoxide catalyst. This particular combination is reacted at a temperature in the range of 400°–450° F. and cooking continued until a predetermined acid value is achieved. Polyester resins of the preferred type having acid values generally below 20 do not form proper dispersions while high acid value polyesters will go into solution. In general terms, however, the polyester should have an acid value that will enable the resin to form a proper aqueous dispersion, and likewise the particle size of the polyester should be such that a good dispersion is achieved. In the event the polyester is anionic in character, as is preferred according to teachings of the present invention, it is generally necessary to include a carboxyl neutralizing agent adequate to ensure that the composition will be at least dispersible. When the polyester is cationic in nature, however, the carboxyl neutralizing agent is not required. Moreover, the carboxyl neutralizing agent may not be required when the polyester is prepared from ingredients which include a dicarboxylic acid such as sodium sulphoisophthalic acid, for example, where the dispersibility mechanism is present in situ.

Preferred polyester resins, as defined herein following polymerization, are cooled to at least a temperature where resin particles will not adhere to adjacent resin particles and the resin is ground at the reduced temperature. In arriving at appropriate temperature conditions for grinding, consideration should be given to the fact that heat is generated during same. Preferably, the polyester resin is cooled to at least a temperature of 0° F., and most preferably, at least about minus 50° F. The ground particles, while remaining cool, will not agglomerate or adhere to adjacent ground particles. As the temperature of the resin returns toward ambient, however, unless precautions are taken, the resin particles will fuse into a mass of material. Depending upon the temperatures at grinding, it may be necessary to also cool the grinder to preclude adherence of resin to grinder surfaces.

Grinding of the polyester resin provides resin of a particle size, outside surfaces of which will be coated during blending with the film former which precludes subsequent resin agglomeration at ambient temperatures or higher. According to teachings of the present invention, a resin particle size of 5 mesh or smaller, U.S. Standard Sieve Size is preferred.

Softer polyester resins of the type preferred herein are normally more appropriate for use in preparing size compositions for suitable yarns as defined herein since the softer resins exhibit appropriate adhesiveness for adherence to the textile material. Harder resins, which in general do not inherently exhibit such adhesive qualities may, however, be utilized in situations where once the resin is ground to a particular particle size, the surface area of the ground resin will regain moisture adequate to impart sufficient adhesive properties thereto. With this harder type resin, it may not be necessary to reduce the temperature of the resin prior to or during the grinding operation, since the harder polyester resins are generally not plastic at ambient temperature.

In reducing temperature of the polyester resin suitable for grinding, any medium may be utilized that will reduce the resin temperature adequate for grinding same without agglomeration of the ground particles. Without limitation, exemplary of suitable cooling mediums are liquid nitrogen and dry ice. Moreover, as mentioned above, depending upon the temperature reached, it may or may not be necessary to likewise cool the grinder.

It is necessary at some point in the process to blend the particulate polyester resin with a film former adequate to coat the resin such that agglomeration of the resin does not thereafter occur once the resin temperature returns to ambient or thereabout. Preferably, blending of the resin and film former occurs immediately after grinding and before the temperature of the ground polyester resin has increased by a substantial amount. Alternatively, the film former may be introduced into the grinder along with the polyester resin such that grinding and blending are carried out simultaneously. While any apparatus may be utilized for grinding the polyester resin that will accept the appropriate cryogenic conditions and grind the resin to the desired particle size, a hammer mill grinder has been found to be suitable. Obviously where the procedure for providing the resin in particulate form is other than grinding, similar blending considerations must be made, i.e., the film former should be added at a time such that subsequent agglomeration of the resin is precluded.

As little as two to three weight percent of the polyester resin in a dry size composition has been demonstrated to yield improved results over the basic size or film former itself. Preferably, from about 5 to about 60 weight percent polyester resin is employed, though the content of polyester resin can be as high as 90 weight percent. In like fashion, the film former is preferably present in a range of from about 5 to about 90 weight percent. In addition to the particulate polyester resin and film former, as mentioned above, unless the polyester resin is of a particular type that does not require same, sufficient carboxyl neutralizing agent should be utilized to render the polymer dispersible. Generally speaking, for preferred polyesters, pH of the blend would be adjusted within in a range of from about 4.0 to about 8.5, preferably from about 5.0 to about 6.5. The neutralizing agent is generally present in the composition, if utilized, in a range of from about 0.25 weight percent to about 0.5 weight percent. Furthermore, in a preferred arrangement, a small amount of a defoamer such as a propylene oxide-ethylene oxide condensate, is present in the dry size composition. Likewise a lubricant, such as a kettle wax as is normally added during preparation of the size dispersions may be added to the present dry size composition.

In preparing size dispersion according to the present invention, the proper size composition to water recipe is provided in a size cooker and is cooked, preferably with live steam at temperatures of approximately 210° F. for from about 15 to about 45 minutes depending upon desired temperature. The dispersion is then applied to the yarn at temperatures of from about 100° F. to about 210° F., preferably from about 160° F. to about 205° F., and most preferably from about 180° F. to about 195° F.

The present invention can better be understood by reference to the following examples.

EXAMPLE 1

A polyester resin was produced by charging 50.877 moles of diethylene glycol; 40.610 moles of isophthalic acid; 5.500 moles of trimellitic anhydride; and 0.01 percent of titanium isopropoxide to a high temperature stainless steel reactor. The reactor was then heated at a temperature of approximately 450° F. and the formulation was cooked for about 12 hours, until an acid value of from about 65 to about 70 was achieved. After reaching the desired acid value, the resin was poured over a rotating flaking cylinder at a temperature of approximately 40° to 45° F. The polyester flakes produced were then chilled to a temperature of from about 0° F. to about minus 50° F. with dry ice and cryogenically ground in a hammer mill grinder to achieve a particle size of from about 5 to about 50 mesh. Immediately thereafter, 20 weight percent ground polyester resin, 79.25 percent starch, 0.50 percent soda ash, and 0.25 percent Pluronic L-61, a propylene oxide-ethylene oxide condensate defoamer manufactured by BASF-Wyandotte were mixed for 30 minutes in a ribbon blender to provide a dry warp size composition.

The above size composition was dispersed in an aqueous medium as follows. One hundred ninety-five pounds of the size composition and 14 pounds of kettle wax were added to a conventional size cooker into 175 gallons of water at ambient temperature and thereafter heated with live steam to a temperature of approximately 210° F. An aqueous dispersion containing 8.5 weight percent solids resulted. The aqueous size dispersion was thereafter applied to 50/50 polyester-cotton spun yarn at a size box temperature of 204° F. Size pick up ranged from 13.9 to 14.5 percent based on the weight of the yarn. Weaving efficiency of the sized yarns was around 95% compared to around 93% for a conventional size. Easy removal of the size in a conventional scour was evident.

EXAMPLES 2–7

Size compositions as listed in Table I were prepared as set forth in Example 1. The compositions were dispersed in an aqueous medium and the dispersion padded onto polyester/cotton spun yarn. Results similar to those of Example 1 were evident.

TABLE 1

| | Example No. | | | | | |
|---|---|---|---|---|---|---|
| | (2) | (3) | (4) | (5) | (6) | (7) |
| Ground Polyester Resin | 20% | 20 | 20 | 50 | 10 | 60 |

TABLE 1-continued

| | Example No. | | | | | |
|---|---|---|---|---|---|---|
| | (2) | (3) | (4) | (5) | (6) | (7) |
| Starch | | | 30 | | | 39.05 |
| PVA | 79.5 | | 20 | | 89.62 | |
| CMC | | 79.5 | 29.5 | 49.15 | | |
| Soda Ash | .25 | .25 | .25 | .60 | .13 | .70 |
| Defoamer | .25 | .25 | .25 | .25 | .25 | .25 |

EXAMPLE 8

Example 1 was repeated with the exception that 5 weight percent of kettle wax that was blended into the formula. This composition then provided a complete dry size package such that nothing further was necessary at the time of preparing the size composition for slashing except water. Again, good results were attained as was the case with Example 1.

EXAMPLE 9

A size bath was produced from 200 pounds of the size composition of Example 1, 240 gallons of water and 16 pounds of kettle wax, and was applied to 100% polyester ring spun yarn, 26/1 count, at a size box temperature of 190° F. and at a pick up of 9.5 percent based on the weight of the yarn. Normal weaving efficiency with a polyvinyl alcohol size is approximately 96%. With the present size composition, a weaving efficiency of more than 99% resulted. The size was easily removed in a conventional scour.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. A dry textile warp size composition for yarns that contains synthetic or natural fibrous materials comprising a blend of a polyester resin, said resin including ionic hydrophilic groups therein, said resin further being at least substantially saturated, and in particulate form, and a film former, said blend being at least water dispersible and the particulate polyester resin in said blend being at least substantially non-adherent to adjacent polyester resin particles.

2. The warp size composition as defined in claim 1 wherein the polyester is present in an amount in a range of from about 10 to about 60 weight percent.

3. The warp size composition as defind in claim 1 wherein the polyester is anionic in nature and the composition further comprises a carboxyl neutralizing agent adequate to achieve desired dispersibility.

4. The composition as defined in claim 1 further comprising a lubricant.

5. The composition as defined in claim 1 wherein hydrophilic groups of the polyester are anionic and are selected from the class consisting of alkali salts of carboxylates, sulfates, sulfonates and phosphates.

6. The composition as defined in claim 1 wherein the hydrophilic groups of the polyester are cationic and are selected from the group consisting of quaternary sulfates and quaternary ammonium chloride.

7. A dry textile warp size composition comprising:

(a) from about 5 to about 90 weight percent of a polyester resin, said polyester including anionic hydrophilic groups thereon, being at least substantially saturated, and being in particulate form;

(b) from about 5 to about 90 weight percent of a film former;

(c) an amount of a neutralizing agent necessary to achieve dispersibility in an aqueous medium; and (d) optionally, a small amount of a defoamer.

8. The composition as defined in claims 1 or 7 wherein the polyester is produced from diethylene glycol, isophthalic acid and trimellitic anhydride, and has an acid value of from about 20 to about 100.

9. The composition as defined in claims 1 or 7 wherein the film former is at least one member selected from a group consisting of starch, carboxymethyl cellulose, and polyvinyl alcohol.

10. The composition as defined in claim 7 further comprising up to about 20 weight percent of a lubricant.

11. The composition as define in claim 1 or 7 wherein the polyester resin is ground to a particle size no larger than about 5 mesh, U.S. Standard Sieve size.

12. A process for producing a textile warp size composition for yarns that contain synthetic or natural fibrous material or blends of same comprising the steps of:

(a) providing a polyester resin that is at least substantially saturated, said resin having ionic hydrophilic groups thereon;

(b) rendering said resin particulate in form, said particles being of a size to permit dispersion of same in an aqueous medium; and (c) mixing a predetermined amount of a film former with said particulate resin adequate to achieve a blend of ingredients in which the resin particles will not agglomerate under normal shipping and storage conditions.

13. The process as defined in claim 12 wherein the polyester resin is prepared by reacting diethylene glycol, isophthalic acid and trimellitic anhydride in presence of a suitable catalyst at temperatures in a range of from about 400° to about 450° F. until an acid value of from about 20 to about 100 is achieved.

14. The process as defined in claim 12 wherein in addition to the film former, a carboxyl neutralizing agent and a defoamer are mixed with the polyester resin.

15. The process as defined in claim 14 wherein further, a lubricant is mixed with the other ingredients.

16. The process as defined in claim 12 wherein the polyester resin is cryogenically ground at a temperature at least as low as 0° F.

17. The process as defined in claim 16 wherein the grinding temperature is below −50° F.

18. The process as defined in claim 16 wherein the film former is mixed with the particulate polyester resin immediately after grinding.

19. The process as defined in claim 16 wherein the film former is mixed with the polyester resin during grinding of the polyesters.

20. The process as defined in claim 12 wherein a carboxyl neutralizing agent, a defoamer and a wax are also mixed with the granular polyester resin.

21. The process as defined in claim 12 wherein 20 weight percent polyester, 79 weight percent starch, 0.25 weight percent soda ash and 0.25 weight percent of a defoamer are mixed.

22. The process as defined in claim 12 wherein the film former is selected from a group consisting of starch, carboxymethyl cellulose, polyvinyl alcohol, and mixtures of same.

23. The process as defined in claims 12 or 13 wherein said resin is ground into particulate form.

* * * * *